US007592303B2

(12) United States Patent
Peters

(10) Patent No.: US 7,592,303 B2
(45) Date of Patent: Sep. 22, 2009

(54) MULTI-PURPOSE CLEANING COMPOSITIONS AND METHOD

(76) Inventor: Donald S. Peters, 450-70 Meadowview Dr., Aurora, OH (US) 44202

( * ) Notice: Subject to any disclaimer, the term of this patent is extended or adjusted under 35 U.S.C. 154(b) by 0 days.

(21) Appl. No.: 11/827,716

(22) Filed: Jul. 14, 2007

(65) Prior Publication Data

US 2009/0018050 A1 Jan. 15, 2009

(51) Int. Cl.
*C11D 1/14* (2006.01)
*C11D 3/06* (2006.01)
*C11D 3/43* (2006.01)

(52) U.S. Cl. ..... 510/467; 510/238; 510/239; 510/405; 510/426; 510/432

(58) Field of Classification Search ..... 510/238, 510/239, 405, 426, 432, 467
See application file for complete search history.

(56) References Cited

U.S. PATENT DOCUMENTS

2002/0082178 A1* 6/2002 Besse et al. ..... 510/197
2005/0282722 A1* 12/2005 McReynolds et al. ..... 510/302
2006/0089281 A1* 4/2006 Gibson ..... 510/201

* cited by examiner

*Primary Examiner*—Brian P Mruk
(74) *Attorney, Agent, or Firm*—Roetzel & Andress, LPA; Joseph J. Crimaldi

(57) ABSTRACT

Various multi-purpose cleaning compositions and the method for using the multi-purpose cleaning compositions are provided. In one embodiment the present invention, the multi-purpose cleaning composition comprises, by weight, from about 10% to about 90% by weight potassium pyrophosphate and from about 90% to about 10% by weight of at least one Group 1 lauryl sulfate. In another embodiment of the present invention, the multi-purpose cleaning composition includes solvent and comprises from about 1% to about 25% by weight of at least one Group 1 pyrophosphate, from about 1% to about 25% by weight of at least one surfactant, and from about 50% to about 98% by weight of at least one solvent. The multi-purpose cleaning compositions of the present invention can be used on various surfaces for improved cleaning of a variety of stains and soils and while also being safe to use and environmentally benign.

16 Claims, No Drawings

MULTI-PURPOSE CLEANING COMPOSITIONS AND METHOD

FIELD OF THE INVENTION

In general, various embodiments of the present invention relates to the field of cleaning compositions for cleaning substrates and/or surfaces, and to a method of cleaning one or more substrates and/or surfaces. In one embodiment, the present invention relates to various multi-purpose cleaning compositions that are formed from a combination of at least one inorganic pyrophosphate (e.g., at least one Group 1 pyrophosphate) and at least one surfactant. In one or more instance, the various embodiments of the present invention relate to multi-purpose cleaning compositions that are suitable for use on various substrates including, but not limited to, hard surfaces, textiles, carpet and skin, and to methods of cleaning such substrates and/or surfaces.

BACKGROUND

A variety of cleaning formulations are available for household use on hard surfaces such as countertops, for use on textiles on upholstery and carpets, for example. Still other cleaning formulations are used on skin to remove dirt and greases, etc.

Several considerations in formulating such compositions include the cleaning ability to dissolve stains and dirt as well as the ability to remove them. For example, in surface cleaning formulations for carpeting, some conventional cleaning compositions interact with the dirt or stain, and the residue can be later removed with a vacuum.

Despite their convenience, several conventional cleaning formulations suffer from a number of disadvantages. Compositions used on hard surfaces such as countertops and porcelain and plastic plumbing fixtures, for example, are acidic or caustic and can damage the substrate to which they are applied. They can also present safety or health hazards to the user. Some carpet compositions, for example, have not have been effective in removing particular stains and even heavy traffic soil stains, while they may also leave behind a tacky residue. The presence of high amount of residues in particular sticky residues contributes to carpet re-soiling which makes the carpet lose its color and brightness. Still yet other stain removers will cause carpet or fabric to change or lose its color.

There remains a need for alternative cleaning compositions useful in removing difficult stains, soap scum, and/or odor from hard and soft surfaces such as carpets, rugs and textiles, without imparting undesirable properties described above or the harmful and toxic exposure to those who use or come into contact with the products.

SUMMARY

In general, the present invention relates to the field of cleaning compositions for cleaning substrates, and the method of cleaning the substrates. In one embodiment, the present invention relates to various multi-purpose cleaning compositions that are formed from a combination of at least one inorganic pyrophosphate (e.g., at least one Group 1 pyrophosphate) and at least one surfactant (e.g., at least one anionic, cationic, amphoteric and/or non-ionic surfactant). In another embodiment, the present invention relates to various multi-purpose cleaning compositions that are formed from a combination of at least one Group 1 pyrophosphate (e.g., sodium pyrophosphate, potassium pyrophosphate, or a mixture thereof), at least one surfactant (e.g., at least one anionic, cationic, amphoteric and/or non-ionic surfactant), and at least one solvent (e.g., water, alcohol, or a mixture thereof). In still another embodiment, the various cleaning compositions of the present invention can further include a wide variety of optional ingredients including, but not limited to, anti-bacterial compounds, anti-mildew compounds, deodorizers, fragrances, perfumes, anti-static, anti-fungal, UV protectantes, etc. In one or more instance, the various embodiments of the present invention relate to multi-purpose cleaning compositions that are suitable for use on various substrates including, but not limited to, hard surfaces, textiles, carpet and skin, and to methods of cleaning such substrates and/or sufarces.

The multi-purpose cleaning composition of the present invention can be used on various surfaces for improved cleaning of a variety of stains and soils and while also being safe to use and environmentally benign. The multi-purpose cleaning compositions herein are non-toxic, non-flammable, bio-degradable, and can be odorless.

In one embodiment of the present invention, the multi-purpose cleaning composition comprises, by weight, from about 10% to about 90% by weight Group 1 (New Notation) pyrophosphate and from about 90% to about 10% by weight of at least one Group 1 lauryl sulfate. In another embodiment of the present invention, the multi-purpose cleaning composition comprises from about 1% to about 25% by weight of at least one Group 1 (New Notation) pyrophosphate, from about 1% to about 25% by weight of at least one surfactant, and from about 50% to about 98% by weight of at least one solvent. In the above embodiments, the ratio of the one or more pyrophosphate compounds to the one or more surfactants is in the range of about 1:10 to about 10:1.

In another embodiment, the multi-purpose cleaning composition comprises from about 5% to about 25% by weight at least one Group 1 pyrophosphate, from about 5% to about 25% by weight of at least one surfactant, and from about 50% to about 90% by weight at least one glycol ether (e.g., one or more glycol ethers according to the following formulas $R_1—OCH_2CH_2OH$, $R_1—OCH_2CH_2OCH_2CH_2OH$, $R_1—OCH_2CH_2O—R_2$, where $R_1$ and $R_2$ are independently selected from $C_1$ to $C_{10}$ linear alkyl groups, $C_2$ to $C_{10}$ branched alkyl groups, or even $C_1$ to $C_5$ linear alkyl groups, or even $C_2$ to $C_5$ branched alkyl groups). In one instance, a multi-purpose cleaning composition that contains at least one glycol ether in combination with at least one Group 1 pyrophosphate and at least one surfactant is very effective in cleaning substrates such as textiles and carpets. In another embodiment, the multi-purpose cleaning composition comprises, by weight, from about 0.1% to about 10% Group 1 pyrophosphate, from about 0.1% to about 10% by weight surfactant, from about 0.5% to about 15% by weight glycol ether, and from about 65% to about 99.3% of at least one solvent (e.g., water, alcohol, or mixture thereof). In the above embodiments, the ratio of the one or more pyrophosphate compounds to the one or more surfactants is in the range of about 1:10 to about 10:1.

In another embodiment, the multi-purpose cleaning composition includes from about 5% to about 45% by weight of at least one Group 1 pyrophosphate, from about 5% to about 45% by weight of at least one surfactant, and from about 10% to about 090% by weight conditioner. In another embodiment, the multi-purpose cleaning composition comprises, by weight, from about 0.1% to about 10% by weight of at least one Group 1 pyrophosphate, from about 0.1% to about 10% by weight of at least one surfactant, from about 0.5% to about 15% by weight glycerin, and from about 65% to about 99.3% by weight at least one solvent (e.g., water, alcohol, or mixture thereof). In one instance, it has been found that the above compositions provides for an excellent body or skin cleaner to remove heavy dirt and grease, for example. In the above embodiments, the ratio of the one or more pyrophosphate compounds to the one or more surfactants is in the range of about 1:10 to about 10:1.

In another embodiment, the various compositions described herein can be safely used on substrates including, but not limited to, chrome, porcelain, textiles, fabrics and/or carpeting. The various compositions of the present invention are colorfast and do not remove dyes in, for example, carpeting or fabrics, yet these cleaning compositions are effective in removing stains including, but not limited to, fruit juice, wine, colored beverages, oil, soil, ink, coffee, tea, soda, crayon, lipstick, spaghetti sauce, tar, greasy foods, soap scum, and/or paint (e.g., latex and/or oil-based paints). Additionally, in one embodiment, the compositions of the present invention are safe to use around children and pets, and are safe for the environment.

DETAILED DESCRIPTION

In general, the present invention relates to the field of cleaning compositions for cleaning substrates, and the method of cleaning the substrates. In one embodiment, the present invention relates to various multi-purpose cleaning compositions that are formed from a combination of at least one inorganic pyrophosphate (e.g., at least one Group 1 pyrophosphate) and at least one surfactant (e.g., at least one anionic, cationic, amphoteric and/or non-ionic surfactant). In another embodiment, the present invention relates to various multi-purpose cleaning compositions that are formed from a combination of at least one Group 1 pyrophosphate (e.g., sodium pyrophosphate, potassium pyrophosphate, or a mixture thereof), at least one surfactant (e.g., at least one anionic, cationic, amphoteric and/or non-ionic surfactant), and at least one solvent (e.g., water, alcohol, or a mixture thereof). In still another embodiment, the various cleaning compositions of the present invention can further include a wide variety of optional ingredients including, but not limited to, anti-bacterial compounds, anti-mildew compounds, deodorizers, fragrances, etc. In still another embodiment, the present invention relates to various cleaning compositions that are suitable for use on various substrates including, but not limited to, hard surface substrates, textiles, carpet and skin, and to methods of cleaning such substrates.

In one embodiments, the various compositions of the present invention are in liquid form, solid form, or in the form of a liquid suspension. In the embodiments, where at least one glycol ether is present, the compounds of the present invention can either be in liquid form or in the form of a liquid suspension. In the case of solid, or powdered, forms of the present invention, such compositions can be diluted in one or more suitable solvents in order to form suitable cleaning compositions designed to treat one or more substrates. In another embodiment, such solid, or powdered, compositions in accordance with one or more embodiments of the present invention can be used to form liquid cleaning concentrates. Such concentrates are formed when a suitable composition in accordance with one or more embodiments of the present invention is added to an amount of solvent less than the amount of solvent necessary to form a cleaning composition of a desired application concentration or strength. Such concentrates can be further diluted to a desired application concentration at, or near, the time of use. Therefore, by "solid form" it is meant that the weights of the cleaning constituents is that of a solid without a solvent, such as water, for example, and by "liquid form" it is meant that the cleaning compositions contain a solvent, typically water. By "diluted form" it is meant that the cleaning compositions can be diluted with an appropriate solvent before being applied onto a substrate or surface.

In one embodiment the multi-purpose cleaning composition comprises at least one Group 1 (New Notation) pyrophosphate and at least one surfactant. In another embodiment, the multi-purpose cleaning composition is substantially free of acids, caustics, and bleaches, for example, as well as other substances which may be detrimental to the surface finish or color of the substrate, or detrimental to the health of the user. As used throughout the specification and the claims, the term "substantially free of" means that there is less than about 0.7%, and in another example, less than about 0.3%, and in another examples, less than about 0.05% by weight of a substance in a given composition (e.g., the multi-purpose cleaning composition).

In another embodiment of the present invention, the multi-purpose cleaning composition includes at least one Group 1 pyrophosphate, at least one surfactant, and at least one solvent. In another embodiment, the multi-purpose cleaning composition is substantially free of acids, caustics, and bleaches, for example, as well as other substances which may be detrimental to the surface finish or color of the substrate, or detrimental to the health of the user.

Group 1 (New Notation) pyrophosphates include, but are not limited to, potassium pyrophosphates (also referred to as potassium pyrophosphate (i.e. TKPP)), sodium pyrophosphate, and mixtures thereof.

Surfactants which can be used include, but are not limited to anionic, cationic, zwitterionic (amphoteric), or nonionic. In one embodiment of the invention, the multi-purpose cleaning composition of the present invention includes one or more surfactants selected from those listed below.

(a) Anionic Suractants: Suitable anionic surfactants for use in conjunction with the present invention include, but are not limited to, sodium dodecyl sulfate (SDS), ammonium lauryl sulfate, and other alkyl sulfates (salts) and salts thereof, sodium laureth sulfate (sodium lauryl ether sulfate—SLES), alkyl benzene sulfonate, soaps, fatty acid salts. Examples of fatty acid salts include, but are not limited to, alkyl fatty acids, alkenyl fatty acids, alkynyl fatty acids that contain from 1 to about 20 carbon atoms in their backbone. Examples of anionic sulfonate or sulfate surfactants include, but are not limited to, sodium xylene sulfonate, sodium dodecylbenzene sulfonate, sodium linear tridecylbenzene sulfonate, potassium octadeceylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfates, sodium $C_{14-17}$ paraffin sulfonate, sodium olefin sulfonate (of 10 to 20 carbon atoms in the olefin), sodium cocomonoglyceride sulfate, sodium cocotallow soap (1:4 coco:tallow ratio), and suitable mixtures thereof. Suitable sodium ethoxylated higher fatty alcohol sulfates include, but are not limited to, those which usually contain about 1 to about 20 ethylene oxide groups per mole, such as sodium lauryl monoethoxy ether sulfate, sodium lauryl diethoxy ether sulfate and sodium $C_{12-14}$ alkyl diethoxy ether sulfate. Additional suitable anionic surfactants also include, but are not limited to, alkyl aryl sulfonate, such as alkyl benzene sulfonate, for example, and hydrocarbon sulfonates, such as alkyl aryl sulfonates.

Suitable lauryl sulfates include Group 1 and Group 2 lauryl sulfates. In another embodiment, suitable lauryl sulfates include, but not limited to, potassium lauryl sulfate, sodium lauryl sufate, calcium lauryl sulfate and magnesium lauryl sulfate, and suitable mixtures of two or more thereof. Suitable lauryl sulfates are commonly known by those of ordinary skill in the art. A suitable sodium lauryl sulfate is supplied in 30% by weight aqueous solution.

(b) Cationic Surfactants: Suitable cationic surfactants include, but are not limited to, cetyl trimethylammonium bromide (CTAB) and other alkyltrimethylammonium salts, cetylpyridinium chloride (CPC), polyethoxylated tallow amine (POEA), benzalkonium chloride (BAC), benzethonium chloride (BZT), and suitable mixtures of two or more thereof.

(c) Zwitterionic Surfactants: Suitable zwitterionic surfactants include, but are not limited to, dodecyl betaine, dodecyl dimethylamine oxide, cocamidopropyl betaine, coco ampho glycinate, and suitable mixtures of two or more thereof.

(d) Non-Ionic Surfactants: Suitable nonionic surfactants include, but are not limited to, alkyl poly(ethylene oxide), copolymers of poly(ethylene oxide) and poly(propylene oxide), alkyl polyglucosides including octyl glucoside and decyl maltoside, fatty alcohols having about 6 to about 40 carbon atoms in their backbone (e.g., cetyl alcohol and oleyl alcohol), cocamide MEA, cocamide DEA, cocamide TEA, and suitable mixtures of two or more thereof.

Suitable solvents for use in conjunction with the present invention include, but are not limited to, water, alcohol and mixtures thereof. In one embodiment, suitable solvents for use in conjunction with the present invention are non-reactive or inert with respect to the other components in the compounds of the present invention. As indicated above, additional solvent can be added to the solid constituents or to liquid mixtures for further dilution of the compositions of the multi-purpose cleaning combinations described herein.

The following combinations are examples of various embodiments of multi-purpose cleaning compositions within the scope of the present invention. However, as would be apparent to those of ordinary skill in the art, the present invention is not limited thereto. Rather, the present invention is to be broadly construed given the disclosure contained herein. In one embodiment the multi-purpose cleaning composition includes at least one Group 1 pyrophosphate and at least one anionic surfactant. In another embodiment, the multi-purpose cleaning composition includes at least sodium pyrophosphate and/or potassium pyrophosphate, and at least one anionic surfactant. In another embodiment, the multi-purpose cleaning composition includes potassium pyrophosphate and at least one Group 1 lauryl sulfate (e.g., potassium lauryl sulfate and/or sodium lauryl sulfate) or Group 2 lauryl sulfate (e.g., calcium lauryl sulfate and/or magnesium lauryl sulfate). In another embodiment, the multi-purpose cleaning compositions discussed within this paragraph can further include at least one solvent (e.g, water, alcohol, and/or mistures of two or more thereof).

In one embodiment, the multi-purpose cleaning composition of the present invention comprise, by weight, from about 10% to about 90% of at least one Group 1 (New Notation) pyrophosphate and from about 90% to about 10% of at least one surfactant. In another embodiment, the multi-purpose cleaning compositions of the present invention comprise from about 30% to about 70% by weight of at least one Group 1 pyrophosphate and from about 70% to about 30% by weight of at least one surfactant, and in another embodiment, from about 40% to about 60% by weight of at least one Group 1 pyrophosphate and from about 60% to about 40% by weight of at least one surfactant. Here, as well as elsewhere in the specification and claims, individual range limits can be combined to form additional range limits.

Therefore, in another embodiment of the present invention, the multi-purpose cleaning composition comprises from about 10% to about 90% by weight potassium pyrophosphate and from about 90% to about 10% by weight of at least one Group 1 lauryl sulfate. In another embodiment, the multi-purpose cleaning composition comprises from about 30% to about 70% by weight potassium pyrophosphate and from about 70% to about 30% by weight of at least one Group 1 lauryl sulfate. In still another embodiment, the multi-purpose cleaning composition comprises from about 40% to about 60% by weight potassium pyrophosphate and from about 60% to about 40% by weight of at least one Group 1 lauryl sulfate, wherein the Group 1 lauryl sulfate is selected from potassium lauryl sulfate and/or a sodium lauryl sulfate.

As mentioned above, the multi-purpose cleaning composition can be also diluted with one or more of the suitable solvents discussed above. In one embodiment of the invention, such diluted, or ready-to-use strength, multi-purpose cleaning compositions comprise from about 1% by weight to about 25% by weight of at least one Group 1 pyrophosphate, from about 1% by weight to about 25% by weight of at least one surfactant, and from about 50% by weight to about 98% by weight of at least one solvent. In another embodiment, the multi-purpose cleaning composition can include, by weight, from about 2% to about 10% of at least one Group 1 pyrophosphate, from about 2% to about 10% by weight of at least one surfactant, and from about 80% to about 96% by weight of at least one solvent. In yet another embodiment, the multi-purpose cleaning composition can include from about 3% by weight to about 5% by weight of at least one Group 1 pyrophosphate, from about 3% by weight to about 5% by weight of at least one surfactant, and from about 90% by weight to about 94% by weight of at least one solvent.

In one embodiment the mixture of Group 1 pyrophospate and surfactant, in solid form or liquid form as a concentrate, is effective for improved cleaning when these ingredients are mixed in particular ratios. For example, the ratio of Group 1 pyrophosphate to surfactant can range from about 10:1 to about 1:10, in another example from about 2:1 to about 1:2, in another example from about 1.2:1 to about 1:1.2, and in yet another example, the ratios are approximately equal.

In another embodiment, a multi-purpose cleaning composition of the present invention comprises from about 1% by weight to about 25% by weight potassium pyrophosphate (i.e., TKPP) and from about 1% by weight to about 25% by weight sodium lauryl sulfate, and from about 50% by weight to about 98% by weight water. In another embodiment, the multi-purpose cleaning composition can include from about 2% to about 10% by weight, potassium pyrophosphate (i.e., TKPP) and from about 2% to about 10% by weight sodium lauryl sulfate and from about 50% to about 96% by weight water. In yet another embodiment, the multi-purpose cleaning composition herein can include from about 3% to about 5% by weight potassium pyrophosphate (i.e., TKPP) and from about 3% to about 5% by weight sodium lauryl sulfate, and from about 90% to about 94% by weight water.

In another embodiment the mixture of Group 1 pyrophospate and surfactant, in solid form or liquid form as a concentrate, the ratio of Group 1 pyrophosphate to surfactant, i.e. Group 1 pyrophosphate:surfactant, can range from about 10:1 to about 1:10, in another example from about 2:1 to about 1:2, in another example from about 1.2:1 to about 1:1.2, and in yet another example, the ratios are approximately equal. For example, in an embodiment in which the cleaning composition includes potassium pyrophosphate and sodium lauryl phosphate, the ratio of pyrophosphate (TKPP) to sodium lauryl sulfate in a range from about 10:1 to about 1:10, in another embodiment from about 2:1 to about 1:2, in another example from about 1.2:1 to 1:1.2, and in yet another example, the ratios are approximately equal to provide effective cleaning. In another embodiment, regardless of whether additional components are present, the ratio of the Group 1 pyrophospate and surfactant are within the ratios described immediately above.

It has been found that the multi-purpose cleaners herein have active ingredients which clean well and which are safe to both the substrate to be cleaned and to users unlike previously known cleaners which can give off harmful fumes and/or cause damage to the substrate to be cleaned during application, or sometime thereafter.

In another embodiment, it has been found that the multi-purpose cleaning composition is highly effective on substrates such as carpet, textiles, fabric and upholstery, when the multi-purpose cleaning compositions described above further include glycol ether.

In one embodiment the multi-purpose cleaning composition comprises at least one Group 1 (New Notation) pyrophosphate and at least one surfactant. In another embodiment, the multi-purpose cleaning composition is substantially free of acids, caustics, and bleaches, for example, as well as other substances which may be detrimental to the surface finish or color of the substrate, or detrimental to the health of the user.

In another embodiment of the present invention, the multi-purpose cleaning composition includes at least one Group 1 pyrophosphate, at least one surfactant, and at least one solvent. In another embodiment, the multi-purpose cleaning composition is substantially free of acids, caustics, and bleaches, for example, as well as other substances which may be detrimental to the surface finish or color of the substrate, or detrimental to the health of the user.

Group 1 (New Notation) pyrophosphates include, but are not limited to, potassium pyrophosphates (also referred to as potassium pyrophosphate (i.e. TKPP)), sodium pyrophosphate, and mixtures thereof.

Surfactants which can be used include, but are not limited to anionic, cationic, zwitterionic (amphoteric), or nonionic. In one embodiment of the invention, the multi-purpose cleaning composition of the present invention includes one or more surfactants selected from those listed below.

(a) Anionic Suractants: Suitable anionic surfactants for use in conjunction with the present invention include, but are not limited to, sodium dodecyl sulfate (SDS), ammonium lauryl sulfate, and other alkyl sulfates (salts) and salts thereof, sodium laureth sulfate (sodium lauryl ether sulfate—SLES), alkyl benzene sulfonate, soaps, fatty acid salts. Examples of fatty acid salts include, but are not limited to, alkyl fatty acids, alkenyl fatty acids, alkynyl fatty acids that contain from 1 to about 20 carbon atoms in their backbone. Examples of anionic sulfonate or sulfate surfactants include, but are not limited to, sodium xylene sulfonate, sodium dodecylbenzene sulfonate, sodium linear tridecylbenzene sulfonate, potassium octadeceylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfates, sodium $C_{14-17}$ paraffin sulfonate, sodium olefin sulfonate (of 10 to 20 carbon atoms in the olefin), sodium cocomonoglyceride sulfate, sodium cocotallow soap (1:4 coco:tallow ratio), and suitable mixtures thereof. Suitable sodium ethoxylated higher fatty alcohol sulfates include, but are not limited to, those which usually contain about 1 to about 20 ethylene oxide groups per mole, such as sodium lauryl monoethoxy ether sulfate, sodium lauryl diethoxy ether sulfate and sodium $C_{12-14}$ alkyl diethoxy ether sulfate. Additional suitable anionic surfactants also include, but are not limited to, alkyl aryl sulfonate, such as alkyl benzene sulfonate, for example, and hydrocarbon sulfonates, such as alkyl aryl sulfonates.

Suitable lauryl sulfates include Group 1 and Group 2 lauryl sulfates. In another embodiment, suitable lauryl sulfates include but are not limited to, potassium lauryl sulfate, sodium lauryl sufate, calcium lauryl sulfate and magnesium lauryl sulfate, and mixtures of two or more thereof.

(b) Cationic Surfactants: Suitable cationic surfactants include, but are not limited to, cetyl trimethylammonium bromide (CTAB) and other alkyltrimethylammonium salts, cetylpyridinium chloride (CPC), polyethoxylated tallow amine (POEA), benzalkonium chloride (BAC), benzethonium chloride (BZT), and suitable mixtures of two or more thereof.

(c) Zwitterionic Surfactants: Suitable zwitterionic surfactants include, but are not limited to, dodecyl betaine, dodecyl dimethylamine oxide, cocamidopropyl betaine, coco ampho glycinate, and suitable mixtures of two or more thereof.

(d) Non-Ionic Surfactants: Suitable nonionic surfactants include, but are not limited to, alkyl poly(ethylene oxide), copolymers of poly(ethylene oxide) and poly(propylene oxide), alkyl polyglucosides including octyl glucoside and decyl maltoside, fatty alcohols having about 6 to about 40 carbon atoms in their backbone (e.g., cetyl alcohol and oleyl alcohol), cocamide MEA, cocamide DEA, cocamide TEA, and suitable mixtures of two or more thereof.

The multi-purpose cleaning composition according to various embodiments of the present invention includes at least one glycol ether (e.g., one or more glycol ethers according to the following formulas $R_1—OCH_2CH_2OH$, $R_1—OCH_2CH_2OCH_2CH_2OH$, $R_1—OCH_2CH_2O—R_2$, where $R_1$ and $R_2$ are independently selected from $C_1$ to $C_{10}$ linear alkyl groups, $C_2$ to $C_{10}$ branched alkyl groups, or even $C_1$ to $C_5$ linear alkyl groups, or even $C_2$ to $C_5$ branched alkyl groups). Examples of glycol ether include, but are not limited to, propylene glycol ether, dipropylene glycol ether, tripropylene glycol ether, propylene glycol methyl ether, dipropylene glycol methyl ether, dipropylene glycol ethyl ether, tripropylene glycol methyl ether, propylene glycol isobutyl ether, ethylene glycol methyl ether, ethylene glycol ethyl ether, ethylene glycol diethyl ether, ethylene glycol dibutyl ether, diethylene glycol methyl ether, diethylene glycol dimethylether, diethylene glycol ethyl ether, diethylene glycol diethyl ether, diethylene glycol butyl ether, ethylene glycol dimethyl ether and other similar materials, and mixtures thereof. The glycol ether solvents which can be used in the multi-purpose cleaning composition can include lower alkyl glycol ethers which are colorless liquids with mild pleasant odors. The boiling points of the materials fall within a range of about 100 to about 250° C.

Suitable solvents for use in conjunction with the present invention include, but are not limited to, water, alcohol and mixtures thereof. In one embodiment, suitable solvents for use in conjunction with the present invention are non-reactive or inert with respect to the other components in the compounds of the present invention. As indicated above, additional solvent can be added to the solid constituents or to liquid mixtures for further dilution of the compositions of the multi-purpose cleaning combinations described herein.

The following combinations are examples of various embodiments of multi-purpose cleaning compositions within the scope of the present invention. However, as would be apparent to those of ordinary skill in the art, the present invention is not limited thereto. Rather, the present invention is to be broadly construed given the disclosure contained herein. In one embodiment the multi-purpose cleaning composition includes at least one Group 1 pyrophosphate and at least one anionic surfactant. In another embodiment, the multi-purpose cleaning composition includes at least sodium pyrophosphate and/or potassium pyrophosphate, and at least one anionic surfactant. In another embodiment, the multi-purpose cleaning composition includes potassium pyrophosphate and at least one Group 1 lauryl sulfate (e.g., potassium lauryl sulfate and/or sodium lauryl sulfate) or Group 2 lauryl sulfate (e.g., calcium lauryl sulfate and/or magnesium lauryl sulfate). In another embodiment, the multi-purpose cleaning compositions discussed within this paragraph can further include at least one solvent (e.g, water, alcohol, and/or mixtures of two or more thereof).

In one embodiment of the present invention, the multi-purpose cleaning composition includes, by weight, from about 5% to about 25% of at least one Group 1 pyrophosphate, from about 5% to about 25% of at least one surfactant, and from about 50% to about 90% of at least one glycol ether. In another example, the multi-purpose cleaning composition includes, by weight, from about 10% to about 20% of at least one Group 1 pyrophosphate, from about 10% to about 20% of at least one surfactant, and from about 60% to about 80% by weight of at least one glycol ether. In yet another example embodiment, the multi-purpose cleaning composition includes from about 7.5% to about 15% of at least one Group 1 pyrophosphate, from about 7.5% to about 15% by weight surfactant and from about 70% to about 85% by weight of at least one glycol ether. In yet another example, the multi-purpose cleaning composition herein includes from about 10% to about 12% of at least one Group 1 pyrophosphate, from about 10% to about 12% of at least one surfactant, and from about 76% to about 80% by weight of at least one glycol ether.

In another embodiment of the present invention, the multi-purpose cleaning composition includes, by weight, from about 5% to about 25% potassium pyrophosphate (i.e. TKPP), from about 5% to about 25% sodium lauryl sulfate, and from about 50% to about 90% dipropylene glycol methyl ether (DPM). In another example, the multi-purpose cleaning composition includes, by weight, from about 10% to about 20% potassium pyrophosphate (i.e. TKPP), from about 10% to about 20% sodium lauryl sulfate, and from about 60% to about 80% by weight dipropylene glycol methyl ether (DPM). In yet another example, a multi-purpose cleaning composition includes from about 7.5% to about 15% potassium pyrophosphate (i.e. TKPP), from about 7.5% to about 15% by weight sodium lauryl sulfate and from about 70% to about 85% by weight dipropylene glycol methyl ether (DPM). In yet another example, herein includes from about 10% to about 12% potassium pyrophosphate (TKPP), from about 10% to about 12% sodium lauryl sulfate, and from about 76% to about 80% by weight dipropylene glycol methyl ether (DPM).

As mentioned above, the multi-purpose cleaning composition can be also diluted in at least one solvent. If the multi-purpose cleaning compositions described above are present in a concentrated powder or liquid form, the compositions may be diluted such that the amount of at least one solvent can range from about 70%-98% by weight at least one solvent. Suitable solvents, but are not limited to, water, alcohols, and mixtures thereof. Therefore, in one embodiment of the invention, the multi-purpose cleaning composition comprises, by weight, from about 0.1% to about 10% Group 1 pyrophosphate, from about 0.1% to about 10% by weight surfactant, from about 0.5% to about 15% by weight glycol ether, and from about 65% to about 99.3% of at least one solvent. In another example, the multi-purpose cleaning composition includes, by weight, from about 0.5% to about 8% Group 1 pyrophosphate, from about 0.5% to about 8% surfactant, and from about 2% to about 12% glycol ether, and from about 72% to about 97% of at least one solvent. In yet another example, a multi-purpose cleaning composition includes, by weight, from about 1% to about 5% Group 1 pyrophosphate, from about 1% to about 5% by weight surfactant, from about 4% to about 11% glycol ether, and from about 79% to about 94% of at least one solvent. In yet another example, the cleaning composition includes, by weight, from about 1.5% to about 3% Group 1 pyrophosphate, from about 1.5% to about 3% surfactant, from about 6% to about 10% glycol ether and from about 84% to about 91% at least one solvent.

In another embodiment of the invention, the multi-purpose cleaning composition includes, by weight, from about 0.1% to about 10% potassium pyrophosphate (i.e. TKPP), from about 0.1% to about 10% sodium lauryl sulfate, from about 0.5% to about 15% dipropylene glycol methyl ether (DPM), and from about 65% to about 99.3% water. In another example, the multi-purpose cleaning composition includes from about 0.5% to about 8% potassium pyrophosphate (i.e. TKPP), from about 0.5% to about 8% sodium lauryl sulfate, from about 2% to about 12% dipropylene glycol methyl ether (DPM), and from about 72% to about 97% water. In yet another example, a multi-purpose cleaning composition includes, by weight, from about 1% to about 5% potassium pyrophosphate (i.e. TKPP), from about 1% to about 5% by weight sodium lauryl sulfate, from about 4% to about 11% by weight dipropylene glycol methyl ether (DPM), and from about 79% to about 94% water. In yet another example, herein includes from about 1.5% to about 3% potassium pyrophosphate (TKPP), from about 1.5% to about 3% sodium lauryl sulfate, from about 6% to about 10% dipropylene glycol methyl ether (DPM), and from about 84% to about 91% water.

In another embodiment the mixture of Group 1 pyrophospate and surfactant, in solid form or liquid form as a concentrate, the ratio of Group 1 pyrophosphate to surfactant, i.e. Group 1 pyrophosphate:surfactant, can range from about 10:1 to about 1:10, in another example from about 2:1 to about 1:2, in another example from about 1.2:1 to about 1:1.2, and in yet another example, the ratios are approximately equal. For example, in an embodiment in which the cleaning composition includes potassium pyrophosphate and sodium lauryl phosphate, the ratio of pyrophosphate (i.e. TKPP) to sodium lauryl sulfate in a range from about 10:1 to about 1:10, in another embodiment from about 2:1 to about 1:2, in another example from about 1.2:1 to 1:1.2, and in yet another example, the ratios are approximately equal. In another embodiment, regardless of whether additional components are present, the ratio of the Group 1 pyrophospate and surfactant are within the ratios described immediately above.

The multi-purpose cleaning compositions described above are also safe and effective for cleaning the body or skin. The multi-purpose cleaner containing Group 1 pyrophosphate and surfactant can further include a conditioner moisturize the body or skin. Therefore, in another embodiment of the present invention the multi-purpose cleaning composition a Group 1 pyrophosphate and salts thereof, surfactant, and conditioner. In another embodiment, the multi-purpose cleaning composition is substantially free of acid, caustics, and bleaches, for example, which may be detrimental to the surface finish or color of the substrate. By the term "substantially free of" it is meant that there is less than about 0.7%, and in another example, less than about 0.3%, and in another examples, less than about 0.05% by weight of a substance in the multi-purpose cleaning composition.

In another embodiment of the present invention, the multi-purpose cleaning composition includes a Group 1 pyrophosphate, a surfactant, conditioner and a solvent. In another embodiment, the cleaning composition is substantially free of acids, caustics, and bleaches, for example, as well as other substances which may be detrimental to the surface finish or color of the substrate, or detrimental to the health of the user.

Group 1 (New Notation) pyrophosphates include, but are not limited to, potassium pyrophosphates (also referred to as potassium pyrophosphate (i.e. TKPP)), sodium pyrophosphate, and mixtures thereof.

Surfactants which can be used include, but are not limited to anionic, cationic, zwitterionic (amphoteric), or nonionic. In one embodiment of the invention, the multi-purpose cleaning composition of the present invention includes one or more surfactants selected from those listed below.

(a) Anionic Suractants: Suitable anionic surfactants for use in conjunction with the present invention include, but are not limited to, sodium dodecyl sulfate (SDS), ammonium lauryl sulfate, and other alkyl sulfates (salts) and salts thereof, sodium laureth sulfate (sodium lauryl ether sulfate—SLES), alkyl benzene sulfonate, soaps, fatty acid salts. Examples of fatty acid salts include, but are not limited to, alkyl fatty acids, alkenyl fatty acids, alkynyl fatty acids that contain from 1 to about 20 carbon atoms in their backbone. Examples of anionic sulfonate or sulfate surfactants include, but are not limited to, sodium xylene sulfonate, sodium dodecylbenzene sulfonate, sodium linear tridecylbenzene sulfonate, potassium octadeceylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfates, sodium $C_{14-17}$ paraffin sulfonate, sodium olefin sulfonate (of 10 to 20 carbon atoms in the olefin), sodium cocomonoglyceride sulfate, sodium cocotallow soap (1:4 coco:tallow ratio), and suitable mixtures thereof. Suitable sodium ethoxylated higher fatty alcohol sulfates include, but are not limited to, those which usually contain about 1 to about 20 ethylene oxide groups per mole, such as sodium lauryl monoethoxy ether sulfate, sodium lauryl diethoxy ether sulfate and sodium $C_{12-14}$ alkyl diethoxy ether sulfate. Additional suitable anionic surfactants also include, but are not limited to, alkyl aryl sulfonate, such as alkyl benzene sulfonate, for example, and hydrocarbon sulfonates, such as alkyl aryl sulfonates.

Lauryl sulfates include Group 1 and Group 2 lauryl sulfates, including but not limited to, potassium lauryl sulfate, sodium lauryl sufate, calcium lauryl sulfate and magnesium lauryl sulfate, and mixtures of two or more thereof.

(b) Cationic Surfactants: Suitable cationic surfactants include, but are not limited to, cetyl trimethylammonium bromide (CTAB) and other alkyltrimethylammonium salts, cetylpyridinium chloride (CPC), polyethoxylated tallow amine (POEA), benzalkonium chloride (BAC), benzethonium chloride (BZT), and suitable mixtures of two or more thereof.

(c) Zwitterionic Surfactants: Suitable zwitterionic surfactants include, but are not limited to, dodecyl betaine, dodecyl dimethylamine oxide, cocamidopropyl betaine, coco ampho glycinate, and suitable mixtures of two or more thereof.

(d) Non-Ionic Surfactants: Suitable nonionic surfactants include, but are not limited to, alkyl poly(ethylene oxide), copolymers of poly(ethylene oxide) and poly(propylene oxide), alkyl polyglucosides including octyl glucoside and decyl maltoside, fatty alcohols having about 6 to about 40 carbon atoms in their backbone (e.g., cetyl alcohol and oleyl alcohol), cocamide MEA, cocamide DEA, cocamide TEA, and suitable mixtures of two or more thereof.

Conditioners include, but are not limited to, glycerin, glucitol (e.g. sorbital), honey, aloe vera, lanolin, essential oils, collagen, lecithin, allantoin (comfrey), calendula, lavender, chamomile, peppermint, elastin, mineral oil.

Suitable solvents for use in conjunction with the present invention include, but are not limited to, water, alcohol and mixtures thereof. In one embodiment, suitable solvents for use in conjunction with the present invention are non-reactive or inert with respect to the other components in the compounds of the present invention. As indicated above, additional solvent can be added to the solid constituents or to liquid mixtures for further dilution of the compositions of the multi-purpose cleaning combinations described herein.

The following combinations are examples of the various embodiments of multi-purpose cleaning compositions within the scope of the present invention. However, as would be apparent to those of ordinary skill in the art, the present invention is not limited thereto. Rather, the present invention is to be broadly construed given the disclosure contained above. In one embodiment the multi-purpose cleaning composition includes Group 1 pyrophosphate, at least one anionic surfactant and at least one conditioner. In another embodiment, the multi-purpose cleaning composition includes at least one of a sodium pyrophosphate and a potassium pyrophosphate, an anionic surfactant and moisturizer. In another embodiment, the multi-purpose cleaning composition includes tetra potassium pyrophosphate; at least one of Group 1 lauryl sulfate, such as potassium lauryl sulfate and sodium pyrophosphate, and Group 2 lauryl sulfate, such as calcium lauryl sulfate and magnesium lauryl sulfate; and at least one conditioner. In another embodiment, the multi-purpose cleaning composition includes tetra potassium pyrophosphate and at least one of Group 1 lauryl sulfate, such as potassium lauryl sulfate and sodium pyrophosphate, and moisturizer. In another embodiment, the multi-purpose cleaning composition includes tetra potassium pyrophosphate, potassium lauryl sulfate, and glycerin. In another embodiment, the multi-purpose cleaning compositions discussed immediately above can further include a solvent, for example water, alcohol, and mixtures thereof.

In one embodiment of the present invention, the multi-purpose cleaning composition comprises, by weight, from about 5% to about 45% Group 1 pyrophosphate, from about 5% to about 45% surfactant, and from about 10% to about 90% conditioner. In another embodiment, the cleaning composition includes, by weight, from about 10% to about 40% Group 1 pyrophosphate, from about 10% to about 40% surfactant, and from about 20% to about 80% conditioner. In another embodiment, the cleaning composition includes, by weight, from about 15% to about 35% Group 1 pyrophosphate, from about 15% to about 35% surfactant, and from about 30% to about 70% conditioner. In yet another embodiment, the cleaning composition includes, by weight, from about 20% to about 35% Group 1 pyrophosphate, from about 20% to about 35% surfactant, and from about 30% to about 60% conditioner.

In one embodiment of the present invention, the multi-purpose cleaning composition comprises from about 5% to about 45% potassium pyrophosphate (i.e. TKPP) from about 5% to about 45% sodium lauryl sulfate, and from about 10% to about 90% glycerine. In another embodiment, the cleaning composition for use on skin can also include from about 10% to about 40% potassium pyrophosphate (i.e. TKPP), from about 10% to about 40% sodium lauryl sulfate and from about 20% to about 80% glycerine. In another embodiment, the cleaning composition includes, by weight, from about 15% to about 35% potassium pyrophosphate (i.e. TKPP), from about 15% to about 35% sodium lauryl sulfate, and from about 30% to about 70% glycerin. In yet another embodiment, the cleaning composition includes, by weight, from about 20% to about 35% potassium pyrophosphate (i.e. TKPP), from about 20% to about 35% sodium lauryl sulfate, and from about 30% to about 60% glycerin.

In practical use, however, the cleaning composition although safe and benign to the environment may be more commonly and/or effectively used when water is added. Therefore, when the composition comprises water, in one embodiment of the invention, the cleaning composition comprises from about 0.1% to about 10% by weight Group 1 pyrophosphate, from about 0.1% to about 10% by weight surfactant, and from about 0.5% to about 15% by weight conditioner, and from about 65% to about 99.3% by weight water. In another embodiment, the cleaning composition includes, by weight, from about 0.5% to about 8% Group 1 pyrophosphate, from about 0.5% to about 8% surfactant, from about 1% to about 10% conditioner, and from about 74% to about 98% solvent. In another embodiment, the cleaning composition includes, by weight, from about 1% to about 6% Group 1 pyrophosphate, from about 1% to about 6% surfactant, from about 2% to about 8% conditioner, and from about 80% to about 96% solvent. In yet another embodiment, the cleaning composition includes, by weight, from about 2% to about 5% Group 1 pyrophosphate, from about 2% to about 5% surfactant, from about 3% to about 7% conditioner, and from about 83% to about 93% solvent.

In another embodiment of the present invention, the multi-purpose cleaning composition comprises, by weight, from about 0.1% to about 10% potassium pyrophosphate (i.e. TKPP), from about 0.1% to about 10% sodium lauryl sulfate, from about 0.5% to about 15% glycerin, and from about 65% to about 99.3% water. In another embodiment, the cleaning composition includes, by weight, from about 0.5% to about 8% potassium pyrophosphate (i.e. TKPP), from about 0.5% to about 8% sodium lauryl sulfate, from about 1% to about 10% glycerin, and from about 74% to about 98% water. In another embodiment, the cleaning composition includes, by weight, from about 1% to about 6% potassium pyrophosphate (i.e. TKPP), from about 1% to about 6% sodium lauryl sulfate, from about 2% to about 8% glycerin, and from about 80% to about 96% water. In yet another embodiment, the cleaning composition includes, by weight, from about 2% to about 5% potassium pyrophosphate (i.e. TKPP), from about 2% to about 5% sodium lauryl sulfate, from about 3% to about 7% glycerin, and from about 83% to about 93% water.

The multi-purpose cleaning compositions herein can be safely used on substrates and/or surfaces which are hard, such as chrome, porcelain, etc. and on substrates and/or surfaces which are soft, such as textile, fabric, carpeting, body skin, etc. The compositions are colorfast and do not remove dyes in carpeting or fabrics for example, yet these cleaning compositions are effective in removing stains such as fruit juice, wine, colored beverages, oil, soil, ink, coffee, tea, soda, crayon, lipstick, spaghetti sauce, tar, greasy foods, soap scum, paint, for example latex and oil-based paints, and other stains, for example. The compositions are safe to use around children and pets, and are safe for the environment. The above compositions also remain in solution for successful commercial distribution and use. The multi-purpose cleaning composition of the present invention can be used on various surfaces for improved cleaning of a variety of stains and soils and while also being safe to use and environmentally benign. The multi-purpose cleaning compositions herein are non-toxic, non-flammable, bio-degradable, and can be odorless.

In still another embodiment, the various cleaning compositions of the present invention can further include a wide variety of optional ingredients including, but not limited to, anti-bacterial compounds, anti-mildew compounds, deodorizers, fragrances, perfumes, anti-static, anti-fungal, etc.

The compositions of the present invention may be applied directly on to the area to be treated or applied using a cloth or piece of material such as a spring device or aerosol can, a sponge, a brush or other mechanical/electrical device. The spraying device may be trigger operated or pump operated or electrically operated or operated by any such pressurized gas such as a can or a pressurizer. The spraying devices ensure uniform coverage of the area to be treated and maximizes the advantage of using liquid aqueous compositions.

In one embodiment of the present invention, the method for cleaning a substrate and/or surface, for example a hard surface or a soft surface such as textile, carpet, fabric and/or upholstry, therefore, comprises contacting the multi-purpose cleaning composition onto a surface, and optionally, rinsing the surface. In another embodiment the method further comprises the step of incorporating the composition into a wipe and contacting the wipe on the surface to be cleaned. In another embodiment, the method can further include applying energy to the substrate, while contacting substrate with the multi-purpose cleaning composition.

In another embodiment the method for cleaning includes contacting the surface and/or substrate, for example a textile, carpet, fabric and/or upholstery, with the multi-purpose cleaning composition herein, covering the substrate and/or surface with a wipe and/or an absorbing material, applying heat to the absorbing material and the surface and/or substrate. In another embodiment, the method for cleaning a textile or fabric includes contacting a first wipe and/or absorbing material with the multi-purpose cleaning composition, placing the first wipe and/or absorbing material on one side of the textile and/or fabric, placing a second wipe and/or absorbing material on the opposite surface of the textile and/or fabric, and applying heat. When heat is applied, care should be taken so as not to damage the substrate. For example, carpeting such as polyolefins and nylons, have a melting temperature of approximately 129° C. and 232° C., respectively.

For an understanding of the nature and objects of this invention, reference may be made to the following examples. These examples are given merely to illustrate and are not to be construed in a limiting sense. All parts, portions and quantities by weight unless otherwise indicated.

EXAMPLES

Comparative evaluations for conducted to demonstrate the unexpected cleaning performance of the inventive compositions. Carpet samples made of 100% nylon manufactured by Mohawk having style Rock Creek no. 62892, having an herbal/tan color was used in the testing. Six types of stain materials are listed below in Table I and were applied onto the carpet samples. The spaghetti sauce was worked in the nap by hand, and the lipstick and crayon were rubbed on the carpet. The Kool-aid®, asphalt and paint were sprayed on the carpet. The stain materials were applied and allowed to dry for three days.

Comparative cleaning compositions (Control 1 and Control 2), and a multi-purpose cleaning composition of the present invention (Example 1) were tested using the following protocol. Some stained materials were sprayed on to the carpet and others were brushed on with a hand brush. The lipstick, spaghetti sauce, crayon, asphalt and paint stain materials were sprayed with six pumps with each of the cleaning composition. As much as the stain as possible was extracted with a 100% cotton terry cloth. A new cloth was used for each stain and for each cleaner. The Kool-aid® stain material was first brushed with a hand brush. The stains were sprayed with 20 pumps of the cleaner. As much of the stain as possible was extracted with a 100% cotton terry cloth, and a new cloth was used for each stain and each cleaner. The cloth was then rinsed in water and another 6 pumps of each cleaner was applied to the respective carpet spots. The stain was extracted repeatedly with the cloth for a total of 6 extractions on each stain.

Clean carpet panels which were stained with Kool-aid were tested for a removal process using heat. The carpet panels were stained and then allowed to dry for four days. A fresh cloth was soaked in water and was placed over the stains. Heat was applied using an iron (1200 Watts and set to maximum heat) which was placed on the wet rag for about 15 seconds. The panels were judged for stain removals and the rankings are listed in the Table I below, with a rating of 1 being the best stain removal to a rating of 3 being the worst.

TABLE I

| Sample Stain Remover | Stain Type | Rating |
|---|---|---|
| Control 1 | Lipstick (Wet n' Wild, #519, red, Markwins Beauty Products, lot 4210) | 3 |
| Control 1 | 20-mL portions of spaghetti sauce (Ragu ® Traditional, batch 2238 Y3A 12164 | 3 |
| Control 1 | Flavored Drink (Kool Aid ® cherry flavor, containing red #40 and blue #1) | 3 (Heat applied) |
| Control 1 | Crayon (Crayola ®, red) | 3 (No Effect) |
| Control 1 | Ashphaltic undercoat (Duplicolor ® "Asphalt Formula", spray can, batch B1951/CC) | 3 (No Effect) |
| Control 1 | Paint (Rust-Oleum ® "Painter's Touch", multipurpose enamel paint #1925, "natural denim", grayish-blue color, spray can) | 3 (No Effect) |
| Control 2 | Lipstick (Wet n' Wild, #519, red, Markwins Beauty Products, lot 4210) | 2 |
| Control 2 | 20-mL portions of spaghetti sauce (Ragu ® Traditional, batch 2238 Y3A 12164 | 3 |
| Control 2 | Flavored Drink (Kool Aid ® cherry flavor, containing red #40 and blue #1) | 2 (Heat applied) |
| Control 2 | Crayon (Crayola ®, red) | 2 |
| Control 2 | Ashphaltic undercoat (Duplicolor ® "Asphalt Formula", spray can, batch B1951/CC) | 3 (No Effect) |
| Control 2 | Paint (Rust-Oleum ® "Painter's Touch", multipurpose enamel paint #1925, "natural denim", grayish-blue color, spray can) | 3 (No Effect) |
| Example 1 | Lipstick (Wet n' Wild, #519, red, Markwins Beauty Products, lot 4210) | 1 |
| Example 1 | 20-mL portions of spaghetti sauce (Ragu ® Traditional, batch 2238 Y3A 12164 | 1 |
| Example 1 | Flavored Drink (Kool Aid ® cherry flavor, containing red #40 and blue #1) | 1 (Heat applied) |
| Example 1 | Crayon (Crayola ®, red) | 1 |
| Example 1 | Ashphaltic undercoat (Duplicolor ® "Asphalt Formula", spray can, batch B1951/CC) | 1 |
| Example 1 | Paint (Rust-Oleum ® "Painter's Touch", multipurpose enamel paint #1925, "natural denim", grayish-blue color, spray can) | 1 |

Tests were performed on chrome, porcelain, painted walls, glass, acrylic. 1 oz of solution (calcium+magnesium salts dissolved in DI water). Also in solution was 1 gram ivory bar soap/1 oz H2O, was sprayed on each substrate and allowed to dry for 24 hours. 7×7 identical squares (2"×2") were used as test panels. 5 mL each sample of multi-purpose cleaning composition were then applied to center of substrate, and allowed 15 minutes to work on dried soap scum. Substrates were then rinsed with DI water and dried (air). Table II shows that the multi-purpose cleaning composition of Example 3 containing by weight, 4% sodium lauryl sulfate, 4% tetrapotassium pyrophosphate, and 92% water, was the only one with no fumes and no damage to any substrate. Example 4 was only one that removed all of soap scum on all substrates. A rating of 1 was the best and 7 was the worst.

TABLE II

| Sample | Active Ingredient | Rating | Surfaces |
|---|---|---|---|
| Control 3 | citric acid, sulfamic acid | 5 | chrome, porcelain, painted walls, glass, and acrylic |
| Control 4 | sodium hypo-chlorite, sodium hydroxide | 7 | chrome, porcelain, painted walls, glass, and acrylic |
| Control 5 | lactic acid, sulfamic acid | 3 | chrome, porcelain, painted walls, glass, and acrylic |
| Control 6 | sulfamic acid | 4 | chrome, porcelain, painted walls, glass, and acrylic |
| Control 7 | hydro-chloric acid | 6 | chrome, porcelain, painted walls, glass, and acrylic |
| Control 8 | phosphoric acid | 2 | chrome, porcelain, painted walls, |

TABLE II-continued

| Sample | Active Ingredient | Rating | Surfaces |
|---|---|---|---|
| | | | glass, and acrylic |
| Example 2 | sodium lauryl sulfate, TKPP and water | 1 | chrome, porcelain, painted walls, glass, and acrylic |

Tests were performed on 2"×2" square unfinished leather. Samples were soiled with grease (automotive), used motor oil, pine tar, mud, transmission fluid. Samples were allowed to dry for 24 hours. The multi-purpose cleaning composition herein and four competitor's products were tested. 5 mL each product applied to center of squares with cotton swab in circular motion. After five minutes samples were wiped with water dampened cotton towel. Table III below shows the results and only Example 4 which contained sodium lauryl sulfate, tetra potassium pyrophosphate, glycerol, water removed all soils and left leather supple and no residue. A rating of 1 was the best and a rating of 4 was the worst.

TABLE III

| Sample | Active Ingredient | Rating |
|---|---|---|
| Control 9 | propylene, glycol, mineral spirits, castoil | 2 |
| Control 10 | dipertene, ethoxylated, alcohol, propylene glycerol | 3 |
| Control 11 | dolimoxone | 4 |
| Control 12 | surfactants blend w/ glycerol | 4 |
| Example 3 | sodium lauryl sulfate, TKPP, glycerol, water | 1 |

Various embodiments of the invention have been described. However, it should be understood that many variations and modifications may be made while remaining within the spirit and scope of the invention.

I claim:

1. A multi-purpose cleaning composition consisting of:

from about 10% to about 90% by weight Group 1 pyrophosphate; and from about 90% to about 10% by weight lauryl sulfate surfactant.

2. The multi-purpose cleaning composition of claim 1, wherein the ratio of Group 1 pyrophosphate to lauryl sulfate surfactant ranges from about 3:7 to about 7:3.

3. A multi-purpose cleaning composition consisting of:

from about 1% to about 25% by weight Group 1 pyrophosphate;

from about 1% to about 25% by weight lauryl sulfate surfactant; and from about 50% to about 98% by weight solvent, wherein the solvent is water.

4. The multi-purpose cleaning composition of claim 1, wherein the Group 1 pyrophosphate is tetra potassium pyrophosphate.

5. The multi-purpose cleaning composition of claim 1, wherein the lauryl sulfate surfactant is sodium lauryl sulfate.

6. The multi-purpose cleaning composition of claim 1, wherein the Group 1 pyrophosphate is tetra potassium pyrophosphate and the lauryl sulfate surfactant is sodium lauryl sulfate.

7. A multi-purpose cleaning composition consisting of:

from about 3% to about 5% by weight tetra potassium pyrophosphate;

from about 3% to about 5% by weight sodium lauryl sulfate surfactant; and from about 90% to about 94% by weight solvent.

8. The multi-purpose cleaning composition of claim 3, wherein the ratio of Group 1 pyrophosphate to surfactant ranges from about 3:7 to about 7:3.

9. A multi-purpose cleaning composition consisting of:

from about 5% to about 45% by weight Group 1 pyrophosphate; and from about 5% to about 45% by weight lauryl sulfate surfactant; and from about 10% to about 90% conditioner.

10. The multi-purpose cleaning composition of claim 9, wherein the ratio of Group 1 pyrophosphate to lauryl sulfate surfactant ranges from about 3:7 to about 7:3.

11. A multi-purpose cleaning composition consisting of:

from about 0.1% to about 10% by weight Group 1 pyrophosphate;

from about 0.1% to about 10% by weight lauryl sulfate surfactant;

from about 0.5% to about 15% conditioner; and from about 65% to about 99.3% by weight solvent, wherein the solvent is water.

12. The multi-purpose cleaning composition of claim 9, wherein the Group 1 pyrophosphate is tetra potassium pyrophosphate.

13. The multi-purpose cleaning composition of claim 12, wherein the lauryl sulfate surfactant is sodium lauryl sulfate and the conditioner is glycerin.

14. A multi-purpose cleaning composition consisting of:

from about 2% to about 5% by weight tetra potassium pyrophosphate;

from about 2% to about 5% by weight sodium lauryl sulfate;

from about 3% to about 7% glycerin; and from about 83% to about 93% by weight water.

15. A multi-purpose cleaning composition consisting of:

from about 0.1% to about 10% by weight Group 1 pyrophosphate;

from about 0.1% to about 10% by weight lauryl sulfate surfactant; and from about 80% to about 99.8% by weight solvent, wherein the solvent is water, wherein the cleaning composition optionally contains a conditioner, anti-bacterial compounds, anti-mildew compounds, deodorizers, fragrances, perfumes, an anti-static compound, or an anti-fungal compound.

16. A multi-purpose cleaning composition consisting of:

from about 1% to about 25% by weight Group 1 pyrophosphate;

from about 1 % to about 25% by weight lauryl sulfate surfactant; and from about 50% to about 98% by weight solvent, wherein the solvent is water, wherein the cleaning composition optionally contains a conditioner, anti-bacterial compounds, anti-mildew compounds, deodorizers, fragrances, perfumes, an anti-static compound, or an anti-fungal compound.

* * * * *